US007017441B2

(12) United States Patent
Hayashihara et al.

(10) Patent No.: US 7,017,441 B2
(45) Date of Patent: Mar. 28, 2006

(54) VEHICLE PEDAL DEVICE CAPABLE OF ADJUSTING PEDAL POSITION IN LONGITUDINAL DIRECTION OF VEHICLE

(75) Inventors: Takashi Hayashihara, Toyota (JP); Akihiko Fukase, Aichi-ken (JP); Nobuyuki Kikukawa, Toyota (JP); Daisuke Nakamura, Nagoya (JP)

(73) Assignee: Toyoda Iron Works Co., Ltd., Toyota (JP)

( * ) Notice: Subject to any disclaimer, the term of this patent is extended or adjusted under 35 U.S.C. 154(b) by 18 days.

(21) Appl. No.: 09/977,248

(22) Filed: Oct. 16, 2001

(65) Prior Publication Data

US 2002/0088303 A1 Jul. 11, 2002

(30) Foreign Application Priority Data

Oct. 19, 2000 (JP) ..... 2000-318781

(51) Int. Cl.
*G05G 1/14* (2006.01)

(52) U.S. Cl. ..... 74/512; 74/516

(58) Field of Classification Search ..... 74/512, 74/516, 517, 518, 560
See application file for complete search history.

(56) References Cited

U.S. PATENT DOCUMENTS 3,643,524 A * 2/1972 Herring ..... 74/512
3,667,314 A * 6/1972 Ritter ..... 74/518
3,678,779 A * 7/1972 Janosi ..... 74/516
4,005,617 A * 2/1977 Sourbel et al. ..... 74/516
5,086,663 A * 2/1992 Asano et al. ..... 74/512
5,771,773 A 6/1998 Sakamoto et al. ..... 91/369.2
5,970,817 A * 10/1999 Ichiba ..... 74/512
2003/0106392 A1 6/2003 Willemsen ..... 74/512

FOREIGN PATENT DOCUMENTS

JP 51-22218 2/1976
JP 7-191773 7/1995
JP 7-205776 8/1995

* cited by examiner

*Primary Examiner*—Chong H Kim

(57) ABSTRACT

A vehicle pedal device including: a depressable portion which is to be operationally depressed by a driver of the vehicle; an output member which is pivotably supported by a supporting shaft provided in a bracket that is fixed to a body of the vehicle, such that the output member is pivoted about the supporting shaft when the depressable portion is operationally depressed, for thereby applying to a motive-power transmitting member an output corresponding to a depression force which is applied to the depressable portion; a longitudinal adjustment device which moves the depressable portion in a longitudinal direction of the body of the vehicle when the depressable portion is not being operationally depressed; and a pedal-ratio varying mechanism which is disposed between the output member and the motive-power transmitting member, and which is capable of adjusting a pedal ratio of the pedal device.

9 Claims, 5 Drawing Sheets

16 : SUPPORTING SHAFT
24 : ROD (MOTIVE-POWER TRANSMITTING MEMBER)
28 : OUTPUT MEMBER
58 : PEDAL-RATIO VARYING MECHANISM
60 : CONNECTING LINK
62 : PIVOT LEVER

VEHICLE PEDAL DEVICE CAPABLE OF ADJUSTING PEDAL POSITION IN LONGITUDINAL DIRECTION OF VEHICLE

DETAILED EXPLANATION OF INVENTION

1. Technical Field of Invention

The present invention relates in general to a pedal device for a vehicle, and more particularly to an improvement in such a pedal device capable of adjusting position of its depressable portion in a longitudinal direction of the vehicle.

2. Prior Art

There is known a vehicle pedal device, such as a brake pedal, accelerator pedal and clutch pedal, which is disposed on a bracket fixed to a vehicle body. The vehicle pedal device has, in its lower end, a depressable portion (e.g. a pedal pad) which is to be operationally depressed. The vehicle pedal device is adapted to press or pull a motive-power transmitting member when the depressable portion is operatively depressed. As a kind of such a vehicle pedal device, there is proposed a device in which the depressable portion is displaceable in the longitudinal direction of the vehicle when the depressable portion is not being operatively depressed. Examples of the device are described in the publication of unexamined Japanese Utility Model Application S51-22218 (conventional example 1) and the publication of unexamined Japanese Patent Application H7-191773 (conventional example 2). In such a proposed device, the position of the depressable portion is displaceable depending on build of a driver of the vehicle, for thereby facilitating his driving of the vehicle.

In the above-described conventional example 1, an output member is supported by a supporting shaft provided in a bracket that is fixed to a vehicle body such that the output member is rotatable about the supporting shaft. An adjusting link is attached at its end to the supporting shaft such that the adjusting link is rotatable about the supporting shaft. A motive-power transmitting member is connected to an end of the output member. A pedal member is rotatably attached to the other end of the adjusting link. The pedal member and the other end of the output member is connected through an interlock link that is parallel to the adjusting link. By rotating the adjusting link, the pedal member is parallely displaced while being held in a fixed posture, whereby a depressable portion is displaced in a longitudinal direction of the vehicle. When the depressable portion is operatively depressed, the output member is pivoted through the interlock link. In the above-described conventional example 2, an output member is supported by a supporting shaft provided in a bracket that is fixed to a vehicle body such that the output member is rotatable about the supporting shaft. A pedal member is attached to this output member through a pair of parallel links. By oscillating the parallel links, the pedal member is parallely displaced in a longitudinal direction of the vehicle while being held in a fixed posture.

Object to be Achieved by Invention

In the above-described conventional vehicle pedal devices, the position of the depressable portion is adjustable in a longitudinal direction of the vehicle. However, since the output member and the motive-power transmitting member are connected directly to each other, the conventional vehicle pedal device provides a low degree of freedom in determining characteristic of a pedal ratio in relation with a depressing stroke, i.e., a ratio at which a depression force is multiplied to drive the motive-power transmitting member in relation with the depressing stroke, or a ratio of a depression amount required for displacing the motive-power transmitting member by a certain amount, in relation with the depressing stroke. The conventional vehicle pedal device provides only relatively simple characteristics such as a characteristic that the pedal ratio is gradually decreased or increased with an increase in the depressing stroke.

In the publication of unexamined Japanese Patent Application H7-205776, there is proposed a technique for improving a degree of freedom in determination of the pedal ratio characteristic, by interposing a pivot lever and a connecting link between a brake pedal and a push rod. That is, by suitably determining connecting positions and postures of the pivot lever and the connecting link, the degree of freedom in the determination of the pedal ratio characteristic is improved. However, in this publication, there is no description regarding application of the technique to a vehicle pedal device which is capable of adjusting the pedal position in a longitudinal direction of the vehicle.

The present invention was made under the above-described background with object of improving a degree of freedom in determination of the pedal ratio characteristic even in a vehicle pedal device capable of adjusting the pedal position in a longitudinal direction of the vehicle, so that the improved degree of the freedom in the determination of the pedal ratio characteristic cooperates with the provision for adjusting the pedal position, to make it possible to obtain a further excellent pedal maneuverability.

Measurement for Achieving the Object

For achieving the above object, the first invention is, in a vehicle pedal device comprising: (a) a depressable portion which is to be operatively depressed by a driver of the vehicle; (b) an output member which is pivotably supported by a supporting shaft provided in a bracket that is fixed to a body of the vehicle, such that the output member is pivoted about the supporting shaft when the depressable portion is operatively depressed, for thereby applying to a motive-power transmitting member an output corresponding to a depression force which is applied to the depressable portion; and (c) a longitudinal adjustment device for moving the depressable portion in a longitudinal direction of the body of the vehicle when the depressable portion is not being operatively depressed; characterized in that there is provided (d) a pedal-ratio varying mechanism which is disposed between the output member and the motive-power transmitting member, and which is capable of adjusting a pedal ratio of the pedal device.

The second invention is, in the vehicle pedal device of the first invention which is capable of adjusting the pedal position in the longitudinal direction of the vehicle, characterized in that (a) the pedal-ratio varying mechanism includes: (a-1) a pivot lever which is supported by an attaching shaft parallel to the supporting shaft and provided in the bracket such that the pivot lever is pivotable about the attaching shaft, the pivot lever being connected to the motive-power transmitting member such that the pivot lever is pivotable relative to the motive-power transmitting member about a first connecting shaft parallel to the attaching shaft; and (a-2) a connecting link which is connected to the pivot lever such that the connecting link is pivotable relative to the pivot lever about a second connecting shaft parallel to the attaching shaft, the connecting link being connected to the output member such that the connecting link is pivotable relative to the output member about a third connecting shaft parallel to the second connecting shaft; (b) wherein the depression force applied to the depressable portion is transmitted from the output member to the motive-power transmitting member via the connecting link and the pivot lever.

The third invention is, in the vehicle pedal device of the first or second invention which is capable of adjusting the pedal position in the longitudinal direction of the vehicle, characterized in that the longitudinal adjustment device includes: (a) an adjusting link which is supported by the supporting shaft such that the adjusting link is pivotable about the supporting shaft and is positioned in a predetermined pivoted position by adjusting means; (b) a pedal member which is connected to the adjusting link such that the pedal member is pivotable relative to the adjusting link about a fourth connecting shaft parallel to the supporting shaft, the pedal member being provided with the depressable portion, so that the pedal member is pivoted about the fourth connecting shaft when the depressable portion is operatively depressed; and (c) an interlock link which is connected to the pedal member such that the interlock link is pivotable relative to the pedal member about a fifth connecting shaft parallel to the supporting shaft, the interlock link being connected to the output member such that the interlock link is pivotable relative to the output member about a sixth connecting shaft parallel to the supporting shaft, the interlock link cooperating with the adjusting link to position the pedal member in a fixed posture, the interlock link being pivoted about the sixth connecting shaft when the adjusting link is pivoted, for thereby causing a circular motion of the pedal member in a longitudinal direction of the vehicle, the interlock link causing the output member to be pivoted about the supporting shaft when the pedal member is pivoted about the fourth connecting shaft with the depressable portion being operatively depressed and with the adjusting link being positioned in a predetermined pivoted position; (d) wherein a line connecting the supporting shaft and the fourth connecting shaft, a line connecting the fourth connecting shaft and the fifth connecting shaft, a line connecting the fifth connecting shaft and the sixth connecting shaft and a line connecting the sixth shaft and the supporting shaft cooperate with each other to substantially define a parallelogram, so that the pedal member is substantially parallely displaced when the adjusting link is pivoted about the supporting shaft.

Effect of the Invention

In the present vehicle pedal device capable of adjusting the pedal position in the longitudinal direction of the vehicle, the pedal-ratio varying mechanism, which is capable of adjusting the pedal ratio, is provided between the output member and the motive-power transmitting member, so that the degree of freedom of determination of the pedal ratio characteristic is increased, and the increased degree of freedom of the determination of the pedal ratio characteristic cooperates with the provision for adjusting the pedal position, to improve the pedal maneuverability.

In the second invention, the connecting link and the pivot lever serving as the pedal-ratio varying mechanism are interposed, and the depression force is transmitted from the output member to the motive-power transmitting member via the connecting link and the pivot lever. Thus, the characteristic of the pedal ratio can be easily varied by suitably determining the posture and connecting position of the pivot lever.

In the third invention, a substantially parallelogram-shaped four-bar linkage is formed by the output member, the adjusting link, the pedal member and the interlock link, which are connected through the supporting shaft, the fourth connecting shaft, the fifth connecting shaft and the sixth connecting shat. Since the pedal member is substantially parallely displaced in the longitudinal direction as a result of pivot movement of the adjusting link about the supporting shaft, the posture of the depressable portion is held in substantially constant irrespective of the adjusted position of the pedal member in the longitudinal direction. Further, since the output member is pivoted through the interlock link about the supporting shaft by an angle substantially equal to an angle by which the pedal member is pivoted with the depressable portion being operatively depressed, the characteristic of the pedal ratio in relation with the depressing stroke is not substantially changed, thereby making it possible to obtain a predetermined constant pedal ratio characteristic.

Embodied Forms of Invention

The present invention is applicable to a brake pedal, accelerator pedal, clutch pedal and any other pedal devices for vehicles. The pedal device of the invention can be adapted such that the depression operating force and the depression operating amount are outputted in a mechanical manner, for example, through the motive-power transmitting member in the form of a brake booster rod which is to be pressed in response to the pedal depression operation, or an accelerator cable or parking brake cable which is to be pulled in the response to the pedal depression operation. However, the pedal device of the invention may be adapted such that a load applied to the motive-power transmitting member and an amount of displacement of the motive-power transmitting member are detected by a detecting device in an electric manner, and the detected load and displacement amount are outputted.

The longitudinal adjustment device can be constituted, for example, by forming a substantially parallelogram-shaped four bar linkage, as in the third invention. However, it is possible to employ various kinds of longitudinal adjustment device such as the device described in the above-described conventional example 2.

Further, the longitudinal adjustment device may be adapted such that the depressable portion is displaceable by a manual operation, or such that the depressable portion is automatically displaceable by an electric motor or other driving means which is activated by a switching operation. The adjusting means of the third invention is disposed between the adjusting link and a member that is associated with the vehicle body.

The pedal-ratio varying mechanism can be constituted to include, for example, the pivot lever and the connecting link, as in the second invention. However, the pedal-ratio varying mechanism may take various forms such as a form including:(a) an intermediate lever which is supported by an attaching shaft parallel to the supporting shaft and provided in the bracket such that the intermediate lever is pivotable about the attaching shaft, the intermediate lever being connected to the motive-power transmitting member such that the intermediate lever is pivotable relative to the motive-power transmitting member about a connecting shaft parallel to the attaching shaft; and (b) an engagement device, such as an elongated hole or other sliding engagement mechanism and a cam mechanism, which is disposed between the intermediate lever and the output member, and which causes the intermediate lever to be pivoted when the output member is pivoted. In the second invention, the pivot lever and the motive-power transmitting member are connected to each other such that the pivot lever and the motive-power transmitting member are pivotable relative to each other about the first connecting shaft. However, it is also possible to connect the pivot lever and the motive-power transmitting member via a connecting link, like the connection of the pivot lever and the output member.

A preferred form of the longitudinal adjustment device of the third invention includes: (a) an adjusting link which is supported by the supporting shaft such that the adjusting link is pivotable about the supporting shaft and is positioned in a predetermined pivoted position by adjusting means; (b) a pedal member which is connected to a lower end portion of the adjusting link such that the pedal member is pivotable relative to the adjusting link about a fourth connecting shaft parallel to the supporting shaft, the pedal member having the depressable portion so that the pedal member is pivoted about the fourth connecting shaft when the depressable portion is operatively depressed; and (c) an interlock link which is connected at a lower end portion thereof to the pedal member such that the interlock link is pivotable relative to the pedal member about a fifth connecting shaft parallel to the supporting shaft and located rearwardly of the fourth connecting shaft, the interlock link being connected at an upper end portion thereof to the output member such that the interlock link is pivotable relative to the output member about a sixth connecting shaft parallel to the supporting shaft and located rearwardly of the supporting shaft, the interlock link cooperating with the adjusting link to position the pedal member in a fixed posture, the interlock link being pivoted about the sixth connecting shaft when the adjusting link is pivoted, for thereby causing a circular motion of the pedal member in a longitudinal direction of the vehicle, the interlock link causing the output member to be pivoted about the supporting shaft when the pedal member is pivoted about the fourth connecting shaft with the depressable portion being operatively depressed and with the adjusting link being positioned in a predetermined pivoted position; (d) wherein a line connecting the supporting shaft and the fourth connecting shaft, a line connecting the fourth connecting shaft and the fifth connecting shaft, a line connecting the fifth connecting shaft and the sixth connecting shaft and a line connecting the sixth shaft and the supporting shaft cooperate with each other to substantially define a parallelogram, so that the pedal member is substantially parallely displaced when the adjusting link is pivoted about the supporting shaft.

In the above-described embodied form, the interlock link is disposed rearwardly of the supporting shaft and the first connecting shaft as viewed in the longitudinal direction of the vehicle. However, the third invention may be embodied such that the interlock link is disposed forwardly of the supporting shaft and the fourth connecting shaft as viewed in the longitudinal direction of the vehicle. Further, while the fourth connecting shaft and the fifth connecting shaft are disposed downwardly of the supporting shaft and the sixth connecting shaft in the above-described embodied form, it is possible to constitute a parallelogrammatic link mechanism even where the fourth connecting shaft and the fifth connecting shaft are disposed upwardly of the supporting shaft and the sixth connecting shaft, respectively.

In the present specification, the term "being pivoted about a shaft" is a synonym of "being pivoted about an axis of a shaft", as long as there is not an obstacle to such an interpretation. The term "being pivoted about a shaft" does not necessarily mean a pivot movement relative to the shaft.

There will be described in detail an embodiment of the present invention, with reference to the drawings.

FIG. 1 is a schematic front view explaining an example of a case where the present invention is applied to a vehicle pedal device in the form of a vehicle brake pedal device 10, and showing a state in which the brake pedal device is installed in a vehicle. The leftward direction as seen in the figure corresponds to the forward direction of the vehicle, while the rightward direction as seen in the figure corresponds to the rearward direction of the vehicle, i.e., a direction toward a driver's seat. The brake pedal device 10 is provided in a bracket 14 which is fixed to a vehicle body 12. When a depressable portion 20, such as a pedal pad, which is provided in a lower end portion of the brake pedal device 10 is operatively depressed, an output member 28 which is adapted to be pivotable about a supporting shaft 16 provided in the bracket 14 is pivoted in the clockwise direction from its original position shown in FIG. 1. A rod 24 of a brake booster is pressed in the forward direction of the vehicle, by the pivoted output member 28 through a connecting link 60 and a pivot lever 62, so that a push rod of a master cylinder which is not shown in the figure is pressed whereby a braking hydraulic pressure is generated in a mechanical manner. In the present embodiment, the rod 24 of the brake booster corresponds to a motive-power transmitting member, and the connecting link 60 and the pivot lever 62 are included in a pedal-ratio varying mechanism 58. The supporting shaft 16 is attached to the bracket 14 such that an axis of the supporting shaft 16 is held substantially parallel to a width direction of the vehicle.

This brake pedal device 10 is equipped with a longitudinal adjustment device 26 for displacing a position of the depressable portion 20 when the depressable portion 20 is not operatively depressed, namely, for displacing an original position of the depressable portion 20, from its forward end as shown in FIG. 1 to its rearward end as shown in FIG. 2. The original position of the depressable portion 20 as displaced to the forward end is indicated by the one-dot chain line in FIG. 2, for facilitating comparison of the original position as displaced to the forward end, with the original position as displaced to the rearward end which is indicated by the solid line in FIG. 2.

The longitudinal adjustment device 26 includes (a) an adjusting link 30 which is connected at its intermediate portion to the output member 28 through the supporting shaft 16 such that the adjusting link 30 is pivotable relative to the output member 28, (b) a pedal member 34 which is connected to a lower end portion of the adjusting link 30 through a connecting shaft 32 parallel to the supporting shaft 16, such that the pedal member 34 is pivotable relative to the adjusting link 30 about the connecting shaft 32, and (c) an interlock link 40 which is connected at its lower end portion to the pedal member 34 through a connecting shaft 36 which is parallel to the supporting shaft 16 and which is located rearwardly of the connecting shaft 32 as viewed in the longitudinal direction of the vehicle, such that the interlock link 40 is pivotable relative to the pedal member 34 about the connecting shaft 36. The interlock link 40 is also connected at its upper end portion to the output member 28 through a connecting shaft 38 which is parallel to the supporting shaft 16 and which is located rearwardly of the supporting shaft 16 as viewed in the longitudinal direction of the vehicle, such that the interlock link 40 is pivotable relative to the output member 28 about the connecting shaft 38. The connecting shafts 32, 36, 38 correspond to fourth, fifth and sixth connecting shafts, respectively.

When the depressable portion 20 is not being operationally depressed, the output member 28 is pressed back about the supporting shaft 16 in the counter-clockwise direction by the rod 24 through the pivot lever 62 and the connecting link 60, so as to be positioned in a certain reference position as shown in FIGS. 1 and 2. With the depressable portion 20 being operationally depressed, the output member 28 is pivoted about the supporting shaft 16 in the clockwise direction, so that the rod 24 is pressed. This state in which the output member 28 is held in the reference position corresponds to a home position of the brake pedal device 10.

The reference position of the output member 28 can be defined by a dimension by which the rod 24 protrudes from the brake booster. However, the reference position of the output member 28 may be defined by a stopper which is provided in the bracket 14 and which is not shown in the figure.

The adjusting link 30 is pivotable about the supporting shaft 16 and is positioned in a predetermined pivoted position by adjusting means 42. The adjusting means 42 is equipped with a screw shaft 46 which is driven to be rotated by a driving means in the form of an electric motor 44, and a nut member 48 which is screwed onto the screw shaft 46. The electric motor 44 is supported by an attaching shaft 50 which is parallel to the supporting shaft 16 and which is provided in an upper portion of the bracket 14 such that the electric motor 44 is rotatable about the attaching shaft 50. The nut member 48 is connected to an upper portion of the adjusting link 30 through a connecting shaft 52 which is parallel to the supporting shaft 16, such that the nut member 48 is rotatable relative to the adjusting link 30 about the connecting shaft 52. When the screw shaft 46 is driven to be rotated, the nut member 48 is linearly moved in the axial direction of the screw shaft 46, so that the adjusting link 30 is pivoted about the supporting shaft 16. The screw shaft 46 has a small lead, and accordingly the nut member 48 is not displaced in the axial direction so that the adjusting link 30 is positioned in a certain pivoted position by stopping the electric motor 44, even if a load is applied to the screw shaft 46 and the nut member 48 in the axial direction, for example, when the depressable portion 20 is operationally depressed.

The interlock link 40 cooperates with the adjusting link 30 to position the pedal member 34 in a predetermined posture. When the adjusting link 30 is pivoted by the adjusting means 42 about the supporting shaft 16 while the depressable portion 20 is not being operationally depressed, the interlock link 40 is also pivoted about the connecting shaft 38 as a result of the pivot movement of the adjusting link 30, whereby the pedal member 34 is given a circular motion in the longitudinal direction of the vehicle so that the depressable portion 20 is positioned in a predetermined position located between the above-described forward and rearward ends. In the present embodiment, there are established relationships $L_{11}=L_{13}$ and $L_{l2}=L_{14}$, where $L_{11}$ represents a link length between the supporting shaft 16 and the connecting shaft 32; $L_{12}$ represent a link length between the connecting shafts 32, 36; $L_{13}$ represents a link length between the connecting shafts 36, 38; and $L_{14}$ represents a link length between the connecting shaft 38 and the supporting shaft 16. Since the relationships $L_{11}=L_{13}$ and $L_{12}=L_{14}$ are established, the depressable portion 20 is parallely displaced in a circular manner while taking a fixed posture. The output member 28, the adjusting link 30, the pedal member 34 and the interlock link 40 constitute a link mechanism (four bar linkage) which connects these members in such a manner that permits the link mechanism to define a parallelogram, so that the pedal member 34 is given a circular motion while the out member 28 takes a fixed posture.

On the other hand, when the depressable portion 20 is operationally depressed while the adjusting link 30 is being positioned by the adjusting means 42 in a predetermined pivoted position, the pedal member 34 is pivoted in the clockwise direction about the connecting shaft 32, whereby the output member 28 is pivoted through the interlock link 40 in the clockwise direction about the supporting shaft 16. The pivot movement of the output member 28 causes the rod 24 to be pressed through the connecting link 60 and the pivot lever 62, whereby a braking force is generated in a mechanical manner. The pivot lever 62 is supported by an attaching shaft 64 which is parallel to the above-described supporting shaft 16 and which is provided in the bracket 14 such that the pivot lever 62 is pivotable about the attaching shaft 64. The pivot lever 62 is connected to the rod 24 through a connecting shaft 66 which is parallel to the attaching shaft 64, such that the pivot lever 62 is pivotable relative to the rod 24 about the connecting shaft 66. The pivot lever 62 is connected also to an end portion of the connecting link 60 through a connecting shaft 68 which is parallel to the attaching shaft 64, such that the pivot lever 62 is pivotable relative to the connecting link 60 about the connecting shaft 68. The connecting link 60 is connected at its other end portion to the output member 28 through a connecting shaft 70 which is parallel to the connecting shaft 68, such that the connecting link 60 is pivotable relative to the output member 28 about the connecting shaft 70. The connecting shafts 66, 68, 70 correspond to first, second and third connecting shafts, respectively.

In the present brake pedal device 10 capable of adjusting the pedal position in the longitudinal direction of the vehicle, the connecting link 60 and the pivot lever 62 are interposed between the output member 28 and the rod 24, so that the operational depression force applied to the depressable portion 20 is transmitted from the output member 28 to the rod 24 via the connecting link 60 and the pivot lever 62. Therefore, by suitably determining the posture and connecting position of the pivot lever 62, i.e., the shape of the pivot lever 62 and the positions of the attaching shaft 64 and the connecting shafts 66, 68, it is possible to easily vary the characteristic of the pedal ratio in relation with a depressing stroke, thereby increasing the degree of freedom of determination of the pedal ratio characteristic. The increased degree of freedom of the determination of the pedal ratio characteristic cooperates with the provision for adjusting the position of the depressable portion 20 in the longitudinal direction of the vehicle, to remarkably improve the pedal maneuverability.

The above-described pedal ratio is a ratio at which the depression force is multiplied to press the rod 24, or a ratio of the depression amount required for pressing the rod 24 by a certain amount. The pedal ratio can be expressed by the following expression in which a dimension of each part indicated in FIG. 1 is used. In the expression, R represents the pedal ratio; the dimension $L_P$ represents an arm length of the pedal member 34; the dimensions $M_1$, $M_2$ represent respective arm lengths of the output member 28 and the pivot lever 62 which are measured from the connecting link 60 as a reference; the dimension $L_H$ represents an arm length from the attaching shaft 64 of the pivot lever 62 to a center line S at which the rod 24 is pressed into the brake booster; and the angle θ represents an angle by which the rod 24 is inclined with respect to the center line S. FIG. 3 is one example of the characteristic of the pedal ratio R, which is obtained in accordance with the expression while the depressing stroke of the depressable portion 20, i.e., the position of the pedal member 34 about the connecting shaft 32 is successively changed. In this example of the characteristic of the pedal ratio R, the pedal ratio R and the ratio of the depression amount required for pressing the rod 24 by the certain amount are reduced in a range where the depressing stroke is large.

$$R=[(L_P \times M_2)/(M_1 \times L_H)] \times \cos\theta \quad (1)$$

On the other hand, in the present embodiment, the parallelogrammatic four bar linkage is formed by the output member 28, the adjusting link 30, the pedal member 34 and the interlock link 40 which are connected through the supporting shaft 16 and the connecting shafts 32, 36, 38. Since the pedal member 34 is parallely displaced in the longitudinal direction of the vehicle as a result of the pivot movement of the adjusting link 30 about the supporting shaft 16, the posture of the depressable portion 20 is held fixed irrespective of the adjustment of the position of the depressable portion 20 in the longitudinal direction. Further, since the output member 28 is pivoted through the interlock link 40 about the supporting shaft 16 by an angle substantially equal to an angle by which the pedal member 34 is pivoted with the depressable portion 20 being operatively depressed, the characteristic of the pedal ratio R in relation with the depressing stroke is not changed, whereby a fixed pedal ratio characteristic which is predetermined can be obtained as shown in FIG. 3.

There will next be explained other embodiments of the present invention.

In a vehicle brake pedal device 80 of FIG. 4, a pedal arm 82 is attached pivotably about the supporting shaft 16, and a depressable portion 86 is provided to a lower end portion of the pedal arm 82 through a longitudinal adjustment device 84. The pedal arm 82 corresponds to the output member, and is connected to the rod 24 through the connecting link 60 and the pivot lever 62. The longitudinal adjustment device 84 is constituted to include a nut member which is not shown in the figure and which is driven to be rotated by an electric motor 88, and a screw shaft 90 which is screwed into the nut member. The depressable portion 86 is integrally fixed to a distal end of the screw shaft 90. With the nut member being driven to be rotated, the screw shaft 90 is linearly moved in the axial direction, whereby the depressable portion 86 is displaced in the longitudinal direction of the vehicle.

Also in this case, like in the above-described embodiment, by suitably determining the posture and connecting position of the pivot lever 62, it is possible to easily vary the characteristic of the pedal ratio in relation with the depressing stroke, thereby increasing the degree of freedom of determination of the pedal ratio characteristic. The increased degree of freedom of the determination of the pedal ratio characteristic cooperates with the provision for adjusting the position of the depressable portion 86 in the longitudinal direction of the vehicle, to remarkably improve the pedal maneuverability.

However, in the present embodiment, since the dimension from the supporting shaft 16 to the depressable portion 86 (the.dimension corresponding to the above-described dimension $L_P$) is changed as a result of the longitudinal displacement of the depressable portion 86, the characteristic of the pedal ratio is changed as a result of the longitudinal displacement of the depressable portion 86. Specifically, where the depressable portion 86 is displaced toward the driver's seat, i.e., in the rearward direction of the vehicle, the dimension from the supporting shaft 16 to the depressable portion 86 is increased whereby the pedal ratio is generally increased throughout all the range of the depressing stroke. Where the depressable portion 86 is displaced in the forward direction of the vehicle, the dimension from the supporting shaft 16 to the depressable portion 86 is reduced whereby the pedal ratio is generally reduced throughout all the range of the depressing stroke.

A vehicle brake pedal device 100 of FIG. 6 is different from the above-described brake pedal device 80 in a pedal-ratio varying mechanism 102 of the brake pedal device 100. The pedal-ratio varying mechanism 102 includes (a) an intermediate lever 108 which is supported by an attaching shaft 104 parallel to the supporting shaft 16 and provided in the bracket 14 such that the intermediate lever 108 is pivotable about the attaching shaft 104, and which is connected to the rod 24 through a connecting shaft 106 parallel to the attaching shaft 104 such that the intermediate lever 108 is pivotable relative to the rod 24 about the connecting shaft 106, and (b) an engagement device in the form of a cam mechanism 112 which is disposed between the intermediate lever 108 and a pedal arm 110 serving as the output member, and which causes the intermediate lever 108 to be pivoted when the pedal arm 110 is pivoted. The cam mechanism 112 includes a cam contact portion 116 which is provided in the intermediate lever 108, and a cam roller 114 which is provided in the output member 110 and which is held in contact with the cam contact portion 116, so that the characteristic of the pedal ratio can be suitably determined by changing, for example, the configuration of the cam contact portion 116. It is also possible to employ a cam mechanism 120, as shown in FIG. 6, which is held in sliding contact. Further, the pedal-ratio varying mechanism 102 in which the cam mechanisms 112, 120 are used can be applied to other vehicle pedal devices such as the vehicle brake pedal device 10 as shown in FIG. 1.

The embodiments of the present invention have been explained in detail with reference to the drawings. However, each of the embodiments is merely an embodied form, and the present invention can be embodied with various modifications and improvements on the basis of knowledge of those skilled in the art.

A schematic front view explaining one embodiment where the present invention is applied to a vehicle brake pedal device, and showing a state in which a depressable portion is positioned in its forward end.

FIG. 2

Figure 1:
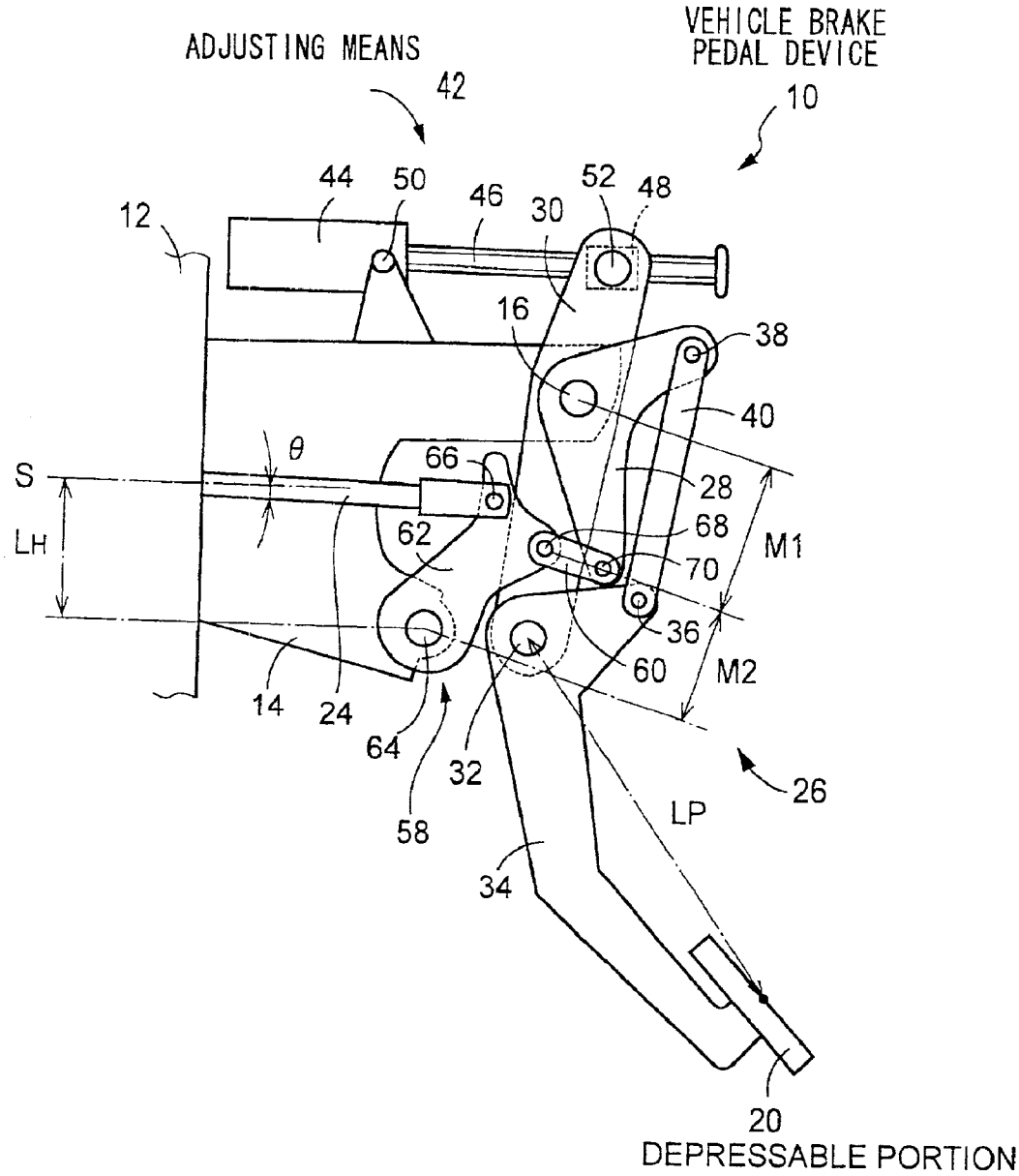
FIG. 1
Figure 2:
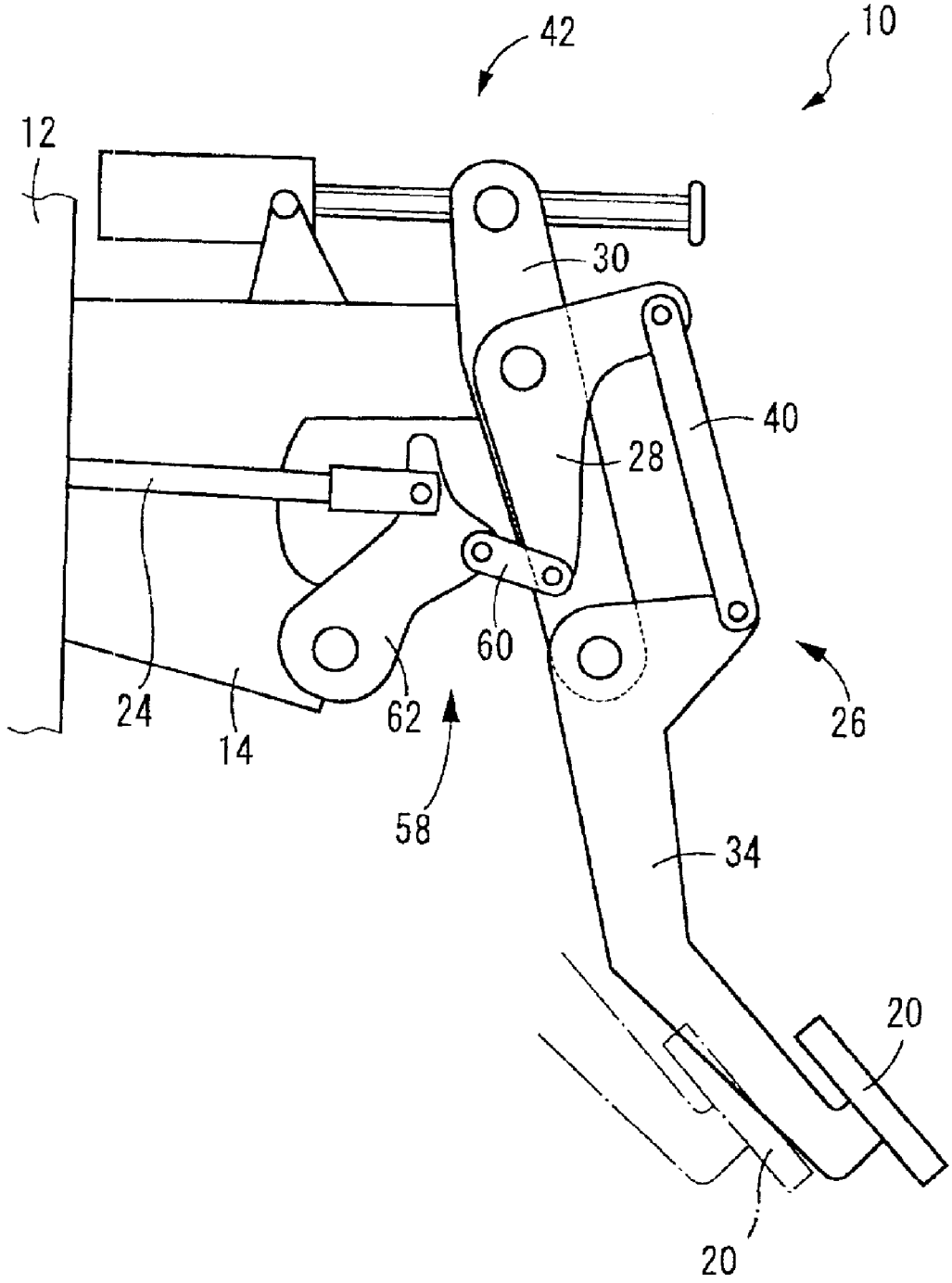
Figure 3:
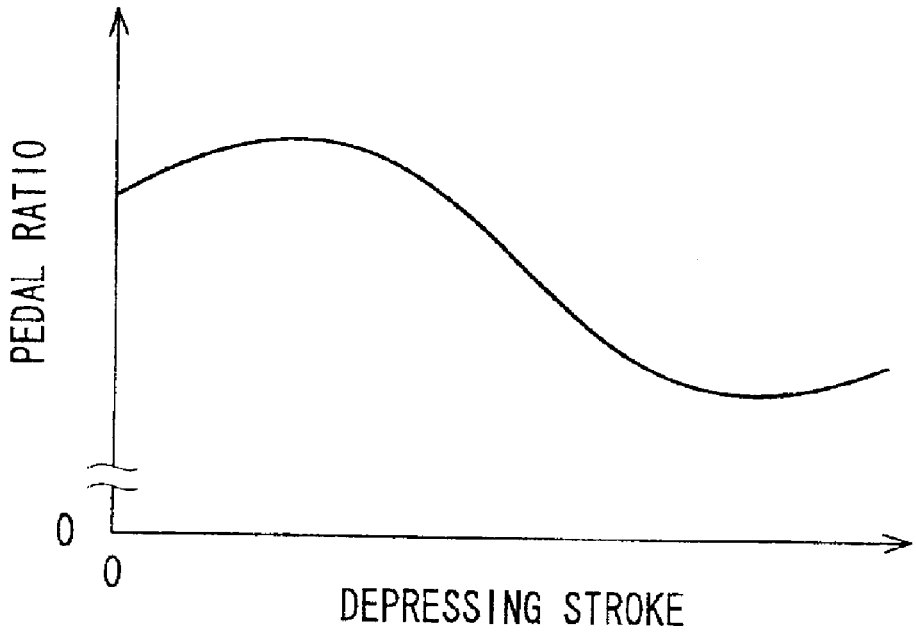
Figure 4:
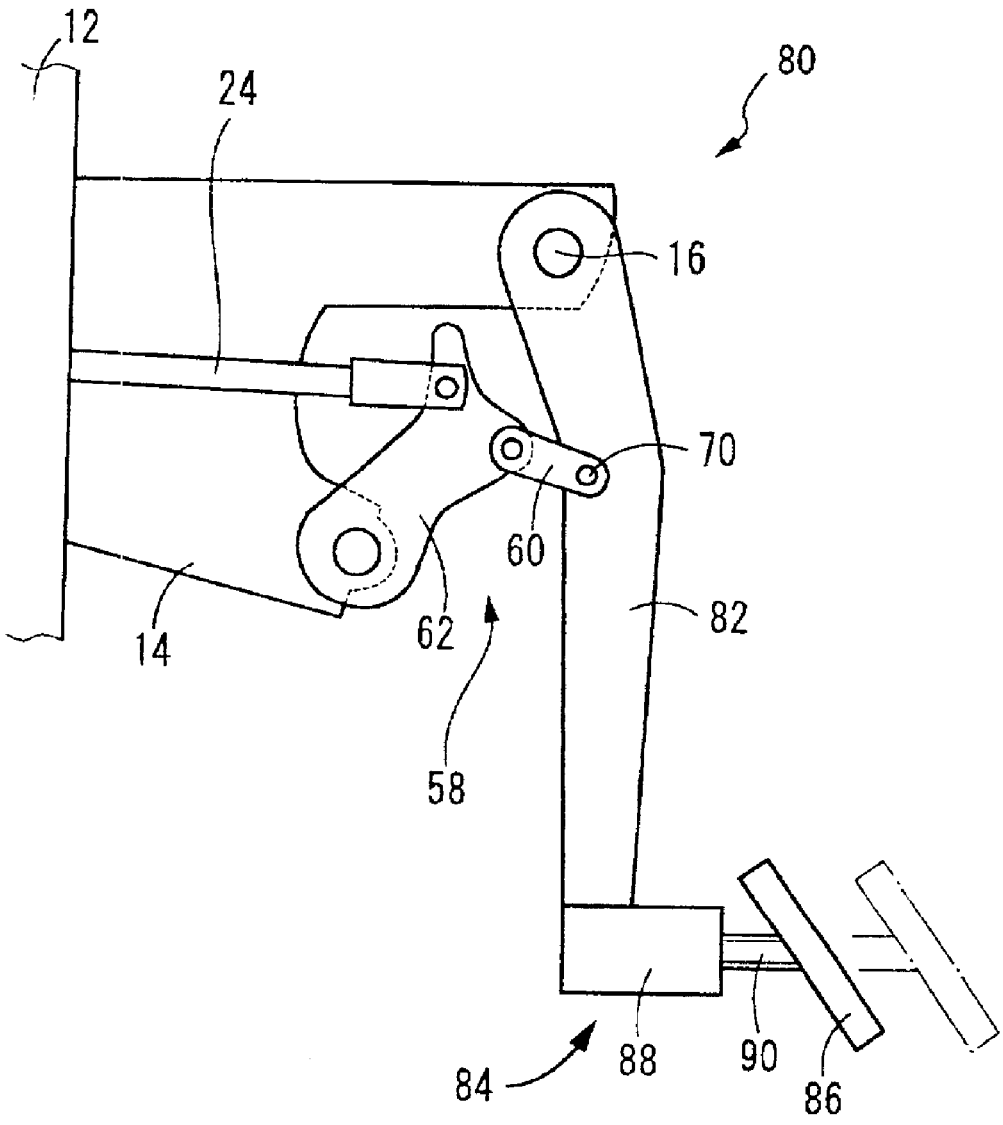
Figure 5:
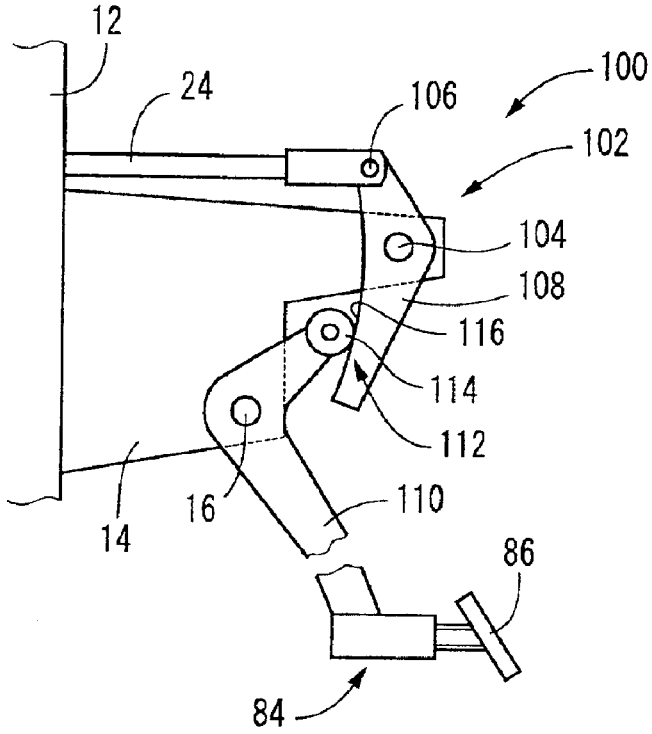
Figure 6:
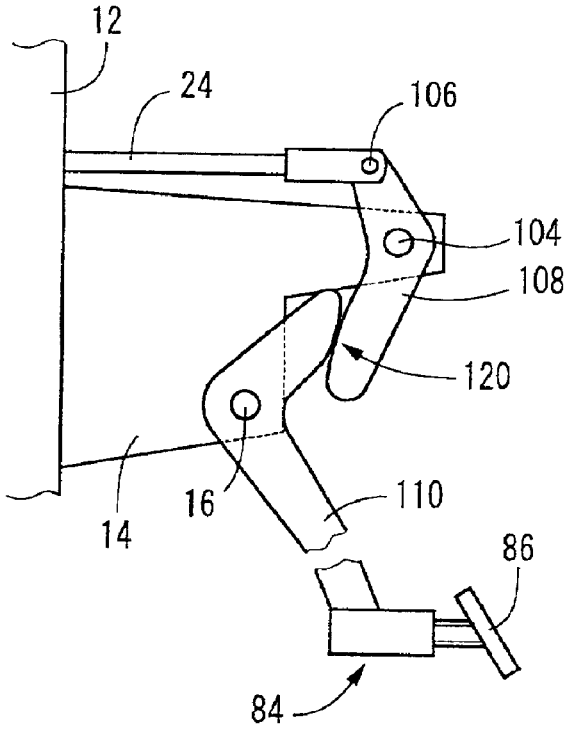

A state in the depressable portion is positioned in its rearward end in the vehicle brake device of FIG. 1.

FIG. 3

A view showing an example of a pedal-ratio characteristic of the brake pedal device of FIG. 1.

FIG. 4

A view showing another embodiment having a longitudinal adjustment device which is different.

FIG. 5

A view showing still another embodiment having a torque-ratio varying mechanism which is different.

FIG. 6

A view showing yet another embodiment.

EXPLANATION OF REFERENCE NUMERALS

10, 80, 100: brake pedal device (vehicle pedal device)

14: bracket

16: supporting shaft

20, 86: depressable portion

24: rod (motive-power transmitting member)

26, 84: output member

30: adjusting link

32: connecting shaft (fourth connecting shaft)

34: pedal member

36: connecting shaft (fifth connecting shaft)

38: connecting shaft (sixth connecting shaft)
40: interlock link
42: adjusting means
58, 102: pedal-ratio varying mechanism
60: connecting link
62: pivot lever
64: attaching shaft
66: connecting shaft (first connecting shaft)
68: connecting shaft (second connecting shaft)
70: connecting shaft (third connecting shaft)
82, 110: pedal arm (output member)

What is claimed is:

1. A pedal device for a vehicle, comprising:

a depressable portion which is to be operationally depressed by a driver of the vehicle;

a out put member pivotably supported by a supporting shaft provided in a bracket that is fixed to a body of the vehicle, such that said output member is pivoted about said supporting shaft when said depressable portion is operationally depressed, for thereby applying to a motive-power transmitting member an output corresponding to a depression force which is applied to said depressable portion;

a longitudinal adjustment device to move said depressable portion in a longitudinal direction of the body of the vehicle when said depressable portion is not being operationally depressed; and a pedal-ratio varying mechanism which is disposed between said output member and said motive-power transmitting member, and which changes a pedal ratio in relation to a depressing stroke of said pedal device;

wherein said pedal-ratio varying mechanism comprises a pivot lever supported by an attaching shaft parallel to said supporting shaft and provided in said bracket such that said pivot lever is pivotable about said attaching shaft, said pivot lever being connected to said motive-power transmitting member through a first connecting shaft parallel to said attaching shaft such that said pivot lever is pivotable relative to said motive-power transmitting member about said first connecting shaft, and a connecting link connected to said pivot lever through a second connecting shaft parallel to said attaching shaft such that said connecting link is pivotable relative to said pivot lever about said second connecting shaft, said connecting link being connected to said output member through a third connecting shaft parallel to said second connecting shaft such that said connecting link is pivotable relative to said output member about said third connecting shaft, and wherein said depression force applied to said depressable portion is transmitted from said output member to said motive-power transmitting member via said connecting link and said pivot lever.

2. A pedal device for a vehicle, comprising:

a depressable portion which is to be operationally depressed by a driver of the vehicle;

an output member pivotably supported by a supporting shaft provided in a bracket that is fixed to a body of the vehicle, such that said output member is pivoted about said supporting shaft when said depressable portion is operationally depressed, for thereby applying to a motive-power transmitting member an output corresponding to a depression force which is applied to said depressable portion;

a longitudinal adjustment device to move said depressable portion in a longitudinal direction of the body of the vehicle when said depressable portion is not being operationally depressed; and a pedal-ratio varying mechanism which is disposed between said output member and said motive-power transmitting member, and which chances a pedal ratio in relation to a depressing stroke of said pedal device, wherein said longitudinal adjustment device comprises an adjusting link supported by said supporting shaft such that said adjusting link is pivotable about said supporting shaft and is adjustably positioned in a predetermined pivoted position;

a pedal member connected to said adjusting link such that said pedal member is pivotable relative to said adjusting link about a fourth connecting shaft parallel to said supporting shaft, said pedal member having said depressable portion so that said pedal member is pivoted about said fourth connecting shaft when said depressable portion is operationally depressed; and an interlock link connected to said pedal member such that said interlock link is pivotable relative to said pedal member about a fifth connecting shaft parallel to said supporting shaft, said interlock link being connected to said output member such that said interlock link is pivotable relative to said output member about a sixth connecting shaft parallel to said supporting shaft, said interlock link cooperating with said adjusting link to position said pedal member in a fixed posture, said interlock link being pivoted about said sixth connecting shaft when said adjusting link is pivoted, for thereby causing a circular motion of said pedal member in a longitudinal direction of the vehicle, said interlock link causing said output member to be pivoted about said supporting shaft when said pedal member is pivoted about said fourth connecting shaft with said depressable portion being operationally depressed and with said adjusting link being positioned in a predetermined pivoted position, and wherein a line connecting said supporting shaft and said fourth connecting shaft, a line connecting said fourth connecting shaft and said fifth connecting shaft, a line connecting said fifth connecting shaft and said sixth connecting shaft and a line connecting said sixth shaft and said supporting shaft cooperate with each other to substantially define a parallelogram, so that said pedal member is substantially parallely displaced when said adjusting link is pivoted about said supporting shaft.

3. A pedal device according to claim 1, wherein said longitudinal adjustment device includes:

an adjusting link supported by said supporting shaft such that said adjusting link is pivotable about said supporting shaft and is adjustably positioned in a predetermined pivoted position;

a pedal member connected to said adjusting link such that said pedal member is pivotable relative to said adjusting link about a fourth connecting shaft parallel to said supporting shaft, said pedal member having said depressable portion so that said pedal member is pivoted about said fourth connecting shaft when said depressable portion is operationally depressed; and an interlock link connected to said pedal member such that said interlock link is pivotable relative to said pedal member about a fifth connecting shaft parallel to said supporting shaft, said interlock link being connected to said output member such that said interlock link is pivotable relative to said output member about a sixth connecting shaft parallel to said supporting shaft, said interlock link cooperating with said adjusting link to position said pedal member in a fixed posture, said interlock link being pivoted about said sixth connecting shaft when said adjusting link is pivoted, for thereby causing a circular motion of said pedal member in a longitudinal direction of the vehicle, said interlock link causing said output member to be pivoted about said supporting shaft when said pedal member is pivoted about said fourth connecting shaft with said depressable portion being operationally depressed and with said adjusting link being positioned in a predetermined pivoted position, and wherein a line connecting said supporting shaft and said fourth connecting shaft, a line connecting said fourth connecting shaft and said fifth connecting shaft, a line connecting said fifth connecting shaft and said sixth connecting shaft and a line connecting said sixth shaft and said supporting shaft cooperate with each other to substantially define a parallelogram, so that said pedal member is substantially parallely displaced when said adjusting link is pivoted about said supporting shaft.

4. A pedal device according to claim 1, wherein said pedal ratio is represented by a ratio of a depressing amount by which said depressable portion is depressed, to a displaced amount by which said motive-power transmitting member is displaced with said depressable portion being depressed by said depressing amount.

5. A pedal device according to claim 1, wherein said pedal-ratio varying mechanism comprises:

an intermediate lever supported by an attaching shaft parallel to said supporting shaft and provided in said bracket such that said intermediate lever is pivotable about said attaching shaft, said intermediate lever being connected to said motive-power transmitting member such that said intermediate lever is pivotable relative to said motive-power transmitting member about a connecting shaft parallel to said attaching shaft; and an engagement device disposed between said intermediate lever and said output member, and which causes said intermediate lever to be pivoted when said output member is pivoted.

6. A pedal device according to claim 5, wherein said engagement device includes:

a cam contact portion formed in said intermediate lever; and a cam roller provided in said output member and which is held in contact with said cam contact portion.

7. A pedal device for a vehicle, comprising;

a depressable portion which is to be operationally depressed by a driver of the vehicle;

an output member pivotably supported by a supporting shaft provided in a bracket that is fixed to a body of the vehicle, such that said output member is pivoted about said supporting shaft when said depressable portion is operationally depressed, for thereby applying to a motive-power transmitting member an output corresponding to a depression force which is applied to said depressable portion;

a longitudinal adjustment device to move said depressable portion in a longitudinal direction of the body of the vehicle when said depressable portion is not being operationally depressed; and a pedal-ratio varying mechanism which is disposed between said output member and said motive-power transmitting member, and which changes a pedal ratio in relation to a depressing stroke of said pedal device, wherein said longitudinal adjustment device comprises an adjusting link supported by said supporting shaft such that said adjusting link is pivotable about said supporting shaft and is adjustably positioned in a predetermined pivoted position;

a pedal member connected to a lower end portion of said adjusting link such that said pedal member is pivotable relative to said adjusting link about a fourth connecting shaft parallel to said supporting shaft, said pedal member having said depressable portion, so that said pedal member is pivoted about said fourth connecting shaft when said depressable portion is operationally depressed; and an interlock link connected at a lower end portion thereof to said pedal member such that said interlock link is pivotable relative to said pedal member about a fifth connecting shaft parallel to said supporting shaft and located rearwardly of said fourth connecting shaft, said interlock link being connected at an upper end portion thereof to said output member such that said interlock link is pivotable relative to said output member about a sixth connecting shaft parallel to said supporting shaft and located rearwardly of said supporting shaft, said interlock link cooperating with said adjusting link to position said pedal member in a fixed posture, said interlock link being pivoted about said sixth connecting shaft when said adjusting link is pivoted, for thereby causing a circular motion of said pedal member in a longitudinal direction of the vehicle, said interlock link causing said output member to be pivoted about said supporting shaft when said pedal member is pivoted about said fourth connecting shaft with said depressable portion being operationally depressed and with said adjusting link being positioned in a predetermined pivoted position, and wherein a line connecting said supporting shaft and said fourth connecting shaft, a line connecting said fourth connecting shaft and said fifth connecting shaft, a line connecting said fifth connecting shaft and said sixth connecting shaft and a line connecting said sixth shaft and said supporting shaft cooperate with each other to substantially define a parallelogram, so that said pedal member is substantially parallely displaced when said adjusting link is pivoted about said supporting shaft.

8. A pedal device according to claim 1, wherein said longitudinal adjustment device comprises an adjusting link supported by said supporting shaft such that said adjusting link is pivotable about said supporting shaft and is adjustably positioned in a predetermined pivoted position;

a pedal member connected to a lower end portion of said adjusting link such that said pedal member is pivotable relative to said adjusting link about a fourth connecting shaft parallel to said supporting shaft, said pedal member having said depressable portion, so that said pedal member is pivoted about said fourth connecting shaft when said depressable portion is operationally depressed; and an interlock link connected at a lower end portion thereof to said pedal member such that said interlock link is pivotable relative to said pedal member about a fifth connecting shaft parallel to said supporting shaft and located rearwardly of said fourth connecting shaft, said interlock link being connected at an upper end portion thereof to said output member such that said interlock link is pivotable relative to said output member about a sixth connecting shaft parallel to said supporting shaft and located rearwardly of said supporting shaft, said interlock link cooperating with said adjusting link to position said pedal member in a fixed posture, said interlock link being pivoted about said sixth connecting shaft when said adjusting link is pivoted, for thereby causing a circular motion of said pedal member in a longitudinal direction of the vehicle, said interlock link causing said output member to be pivoted about said supporting shaft when said pedal member is pivoted about said fourth connecting shaft with said depressable portion being operationally depressed and with aid adjusting link being positioned in a predetermined pivoted position;

wherein a line connecting said supporting shaft and said fourth connecting shaft, a line connecting shaft and said fifth connecting shaft, a line connecting said fifth connecting shaft and said sixth connecting shaft and a line connecting said sixth shaft and said supporting shaft cooperate with each other to substantially define a parallelogram, so that said pedal member is substanially parallely displaced when said adjusting link is pivoted about said supporting shaft.

9. A pedal device according to claim 2, wherein said pedal ratio is represented by a ration of a depressing amount by which said depressable portion is depressed, to a displaced amount by which said motive-power transmitting member is displaced with said depressable portion being depressed by said depressing amount.

* * * * *

UNITED STATES PATENT AND TRADEMARK OFFICE

CERTIFICATE OF CORRECTION

PATENT NO. : 7,017,441 B2
APPLICATION NO. : 09/977248
DATED : March 28, 2006
INVENTOR(S) : Takashi Hayashihara et al.

It is certified that error appears in the above-identified patent and that said Letters Patent is hereby corrected as shown below:

Column 11, line 16, change “a out put” --an output--

Column 12, line 7, change “chances” to --changes--

Column 13, line 50, change “comprising;” to --comprising:--

Column 16, line 2, after “line connecting” insert --said fourth connecting--

Column 16, line 7, change “substanially” to --substantially--

Column 16, line 10, change “ration” to --ratio--

Signed and Sealed this

Fifteenth Day of May, 2007

JON W. DUDAS
*Director of the United States Patent and Trademark Office*